United States Patent [19]

Jensen et al.

[11] Patent Number: 4,842,480

[45] Date of Patent: Jun. 27, 1989

[54] MULTI-STAGE INLINE ROTARY PUMP

[75] Inventors: Niels D. Jensen; Soren Simonsen, both of Bjerringbro, Denmark

[73] Assignee: Grundfos International a/s, Bierringbro, Denmark

[21] Appl. No.: 89,211

[22] Filed: Aug. 25, 1987

[30] Foreign Application Priority Data

Aug. 27, 1986 [DE] Fed. Rep. of Germany ..... 3629123

[51] Int. Cl.[4] ..... F04D 17/12

[52] U.S. Cl. ..... 415/199.1; 415/214.1

[58] Field of Search ..... 415/126, 127, 128, 199.1, 415/199.2, 199.3, 219 C, 501; 29/510, 511, 515, 516; 403/282, 280

[56] References Cited

U.S. PATENT DOCUMENTS

| | | | |
|---|---|---|---|
| 1,527,471 | 2/1925 | Clinchy et al. | 29/511 X |
| 1,648,026 | 11/1927 | Murray | 403/282 X |
| 2,753,807 | 7/1956 | Lung | 415/199.2 |
| 2,902,934 | 9/1959 | Louis | 29/511 X |
| 2,957,426 | 10/1960 | Miller | 415/199.1 X |
| 4,116,583 | 9/1978 | Budris | 415/199.1 |
| 4,134,200 | 1/1979 | Frigo | 29/511 X |

FOREIGN PATENT DOCUMENTS

| | | | |
|---|---|---|---|
| 55656 | 7/1982 | European Pat. Off. | 29/511 |
| 1344168 | 1/1970 | United Kingdom | 415/199.1 |

OTHER PUBLICATIONS

Kreiselpumpen; Berechnung und Konstruktion—Adam T. Troskolanski und Stephan Lazarkiewicz.

*Primary Examiner*—Robert E. Garrett
*Assistant Examiner*—Joseph M. Pitko
*Attorney, Agent, or Firm*—Balogh, Osann, Kramer, Dvorak, Genova & Traub

[57] ABSTRACT

A multistage in-line rotary pump which comprises a closed pump body, a base element provided with suction and delivery connectors, and a head element. The pump body is surrounded by a cylindrical jacket or casing spaced from the pump body to form an annular return space, which casing is clamped between the base and head elements by means of stay bolts. Flat joints are provided between the base and head elements and the respective axial ends of the casing. To prevent high areal compression stresses in the area of the flat joints, the two extremities of the casing are plastically deformed to obtain a wall thickness which is greater than the wall thickness of the rest of the casing tube.

6 Claims, 2 Drawing Sheets

MULTI-STAGE INLINE ROTARY PUMP

BACKGROUND OF THE INVENTION

This invention relates to a multistage in-line rotary pump comprising a closed pump body, a base element provided with suction and delivery connectors and a head element, the pump body being surrounded by a cylindrical jacket or casing spaced from it to form an annular return volume and said casing being braced between the base and head elements by means of stay bolts and flat joints.

So that the in-line principle may be embodied in such pumps with suction and delivery connectors situated on the same axis, the flow conveyed has to be led back to the suction side, situated in the base element from the delivery side of the pump body situated in the head element. This occurs within an annular volume between the pump body and the casing enclosing it. Since the casing and the base and head elements form the pressure-tight delimitation between the fluid and the environment, these components must be sealed with respect one to another. This may be accomplished either by shaped seals or packing boxes, which is however onerous and costly.

A pump of this nature becomes substantially simpler and cheaper if the base element, the casing and the head element are sealed with respect to each other by flat joints. One disadvantage of this structural solution however is that the joints will be located in areas of high areal compression. A torque acting against the direction of rotation of the motor, which tends to twist the parts which are to be sealed with respect to each other is engendered when the motor is turned on or off. If relative displacements occur between the sealed parts during switching the risk arises that the joints may be cut up because of the sharp edges of the casing and that the pump will break down after only a brief period of operation. To prevent damage of this kind, the components in question are commonly tightened against each other more powerfully than is actually required for sealing purposes.

So that the joints are not cut up, that is to say to reduce areal compression, it had already been proposed that the extremities of the jacket or casing should be flanged over or made larger as regards the effective compression area by insertion of a ring, the ring normally being welded to the casing. The flanging-over operation does not resolve the problem in the case of thin-gauge casings because the flanged area may be pushed up by the comparatively great forces, so that this measure will not prevent excessive compression of the joint. The insertion of a ring to enlarge the contact surface furthermore has the disadvantage that a corrosion-promoting interstice will normally be formed.

SUMMARY OF THE INVENTION

The invention has as its fundamental object to reinforce the casing extremities in an uncomplicated manner so that the disadvantages of the previously proposed solutions are prevented.

This object is achieved in an in-line rotary pump of the type referred to in the foregoing, in that the two extremities of the casing are plastically deformed to a wall thickness which is greater than the wall thickness of the rest of the casing tube. The ratio of the wall thickness at the deformed casing extremities to that of the rest of the casing tube is preferably from 1.5:1 to 3.0:1.

Furthermore, the two casing extremities should preferably be deformed asymmetrically and radially inwardly by upsetting, the external diameter of the casing tube being maintained even in the area of deformation. On the other hand, it is also possible and indeed advantageous for the casing tube to form at least one deformation projecting radially outwards and preferably forming an encircling centering ring on the external periphery of its two extremities, in each case.

Tests have shown that upsetting of the casing extremities causes a reinforcement of the casing tube which will extend over an axial length h. The ratio h:s, where s is the wall thickness of the casing tube, should preferably be in the range from 2:1 to 5:1.

At a predetermined pretensioning of the stay bolts, the areal compression engendered is now reduced according to the ratio between the wall thickness in the area of the deformation and the wall thickness of the casing tube, so that even a sudden temperature rise in the flow conveyed and the additional stress on the joint caused thereby because of a thermal expansion of the casing, will not lead to destruction of the flat joints.

Another advantage of the invention resides in the economical production of the casing tube which need only be deformed by upsetting, which by virtue of the shape imparted to it eliminates at least the greater part of the risk of damaging the flat joints by relative displacements between the casing and joint as well as by excessive compression of the joint caused by a possible thermal shock within the operational range of the pump.

Further objects and advantages of the invention will become apparent from the following detailed description with reference to the accompanying drawings, which illustrate a preferred embodiment thereof.

DETAILED DESCRIPTION OF THE PREFERRED EMBODIMENTS

Figure 1:
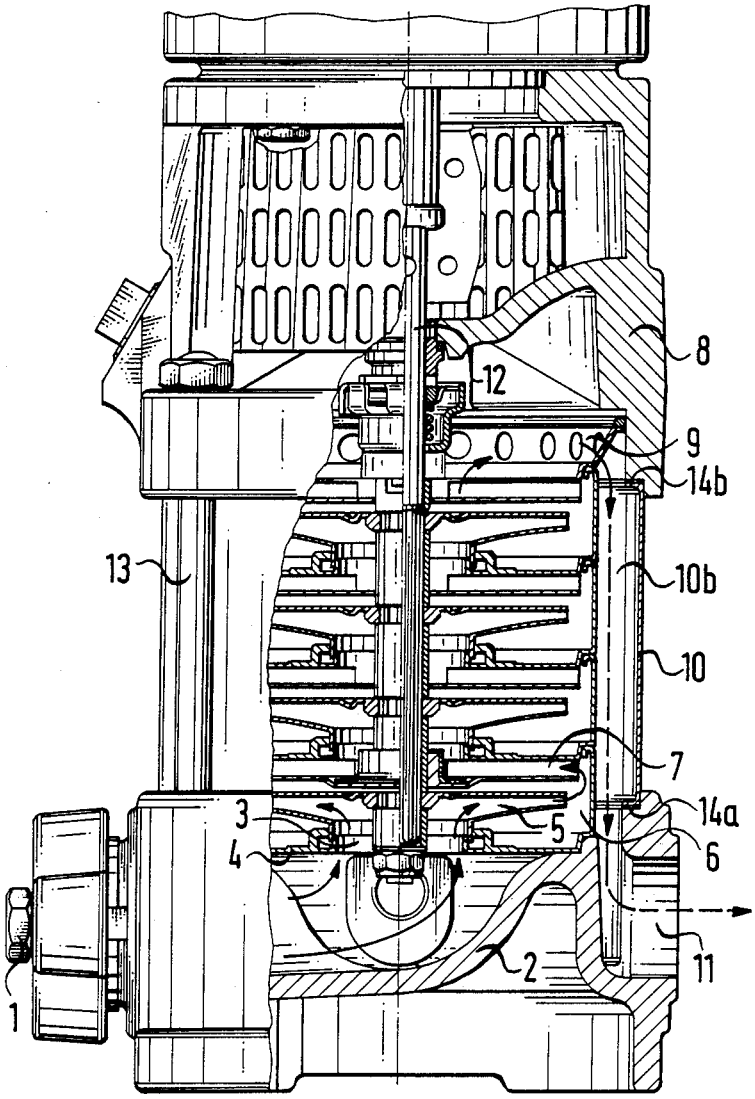
FIG. 1 shows a sideview of an in-line rotary pump in accordance with the invention in partial cross-section.

Referring first to FIG. 1 there is shown a rotary pump comprising a base element 2, a series of four pump stages, a head element 9 and an outer casing 10. The pump is driven by a shaft 12.

Water enters into the base element 2 of the pump via a suction connector 1. The water initially passes into a bottom impeller 5 of the first pump stage through a suction opening 3 of a stage housing 4, from which it is forced into an annular space 6 of the housing 4. The water flows onwards through return blade passages 7 to the impeller of the next pump stage. Depending on the pressure difference required, a corresponding number of stages is connected in series, the totality of these then forming the outwardly closed pump body.

The water conveyed to the head element 8 of the pump flows through holes in a bearer ring 9 into an annular space **10*b* formed between the casing 10 and the pump body, through which it is led back to the base element 2, where the water emerges through a delivery connector 11. The pump shaft 12** is sealed off from the environment by means of a slip ring seal.

The base element 2, the head element 8 and the casing 10 are drawn one towards another by the stay bolts 13, with flatjoints 14*a* and 14*b* interposed. These joints are installed in both areal compression areas, as shown in FIG. 1.

Figure 2:
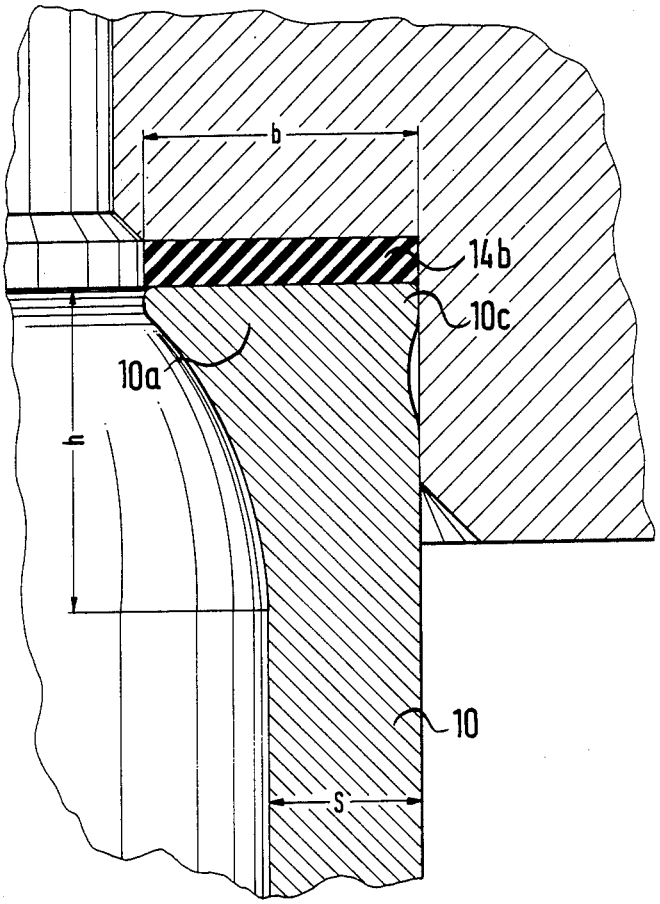
FIG. 2 shows in detailed cross-section the area of a casing extremity encircled in FIG. 1.

Reference is now made to FIG. 2 for a clearer understanding of the invention.

A part of the head element 8 and the flat joint 14*b* situated between this head element and the deformed casing extremity 10*a* are shown in this figure. It is apparent that the extremity of the casing tube 10 has been widened to the dimension b by plastic deformation according to the invention, this dimension b being substantially greater than the wall thickness of the remanent casing tube. In this case, both casing extremities were deformed asymmetrically and radially in an inward direction.

Whilst making this deformation, it is possible in principle to retain the external diameter of the casing tube 10 in the area of deformation of the casing extremities 10*a*. In order to ensure precise centering of the casing tube extremities in the base element 2 and head element 8, it will commonly be more appropriate however for at least one radially outwardly directed deformation 10*c* to be produced for example at the same time as the radially inwardly directed deformation, which may form a closed externally encircling centring ring by means of which the casing tube may be borne in the corresponding seats of the head and base elements. The projections 10*c* need not however necessarily be constructed in the form of a closed ring, since it may be sufficient for the specified purpose to form separate projections instead of a ring. So that the system may be produced in a precisely determined and sufficiently stable configuration, at least three projections should be provided in this case at the head and base casing extremities, in each case.

As already mentioned above, the wall thickness b at the casing extremities 10*a* should satisfy the condition $1.5 \leqq b/s \leqq 3.0$ where s is the wall thickness of the casing tube 10. Practical experiments have shown that these ratios lead to a particularly advantageous solution in which cutting up of the flat joints, and thus also possible sealing problems, may be avoided under all operating conditions normally encountered.

What is claimed is:

1. A multistage in-line rotary pump comprising a closed pump body, a base element provided with the suction and delivery connectors and a head element, the pump body being surrounded by a cylindrical casing spaced therefrom to form an annular return space, which casing is braced between said base and head elements by means of stay bolts with flat joints provided between said base and head elements and respective axial ends of the casing, wherein said casing ends have their wall thickness increased by plastic deformation relative to the wall thickness of the rest of the casing, wherein said casing ends are predeformed asymmetrically and radially inwards so that their wall thickness is increased by plastic deformation relative to the rest of the casing.

2. A rotary pump as claimed in claim 1, wherein the relationship between the wall thickness (b) at said axial ends of the casing to the wall thickness (s) of the rest of the casing tube satisfies the condition:

$$1.5 \leqq b/s \leqq 3.0.$$

3. A rotary pump as claimed in claim 1 wherein said casing ends are deformed over an axial length (h) whose relationship to the wall thickness (s) of the rest of the casing tube satisfies the condition:

$$2 \leqq h/s \leqq 5.$$

4. A rotary pump as claimed in claim 1, wherein the casing tube has a constant external diameter throughout its length including the area of deformation at its axial ends.

5. A rotary pump as claimed in claim 1, wherein the casing tube has at least one deformation projecting radially outwards at each of its axial ends.

6. A rotary pump as claimed in claim 5, wherein said projecting deformation defines a centering ring surrounding each said axial end of the casing.

* * * * *